US005522583A

United States Patent [19]

Martin

[11] Patent Number: 5,522,583

[45] Date of Patent: Jun. 4, 1996

[54] POWERED HYDRAULIC JACK

[76] Inventor: William A. Martin, 124 Elma-McCleary Ave, #38, Elma, Wash. 98541

[21] Appl. No.: 328,780

[22] Filed: Oct. 28, 1994

[51] Int. Cl.[6] ..... B66F 3/24

[52] U.S. Cl. ..... 254/93 H

[58] Field of Search ..... 254/93 H, 93 R, 254/423, 1, 89 H, 418, DIG. 2

[56] References Cited

U.S. PATENT DOCUMENTS

| | | | |
|---|---|---|---|
| 2,034,605 | 3/1936 | Carman | 254/93 H |
| 2,420,910 | 5/1947 | Richards | 254/93 H |
| 2,471,770 | 5/1949 | Noble | 254/93 H |
| 4,377,190 | 3/1983 | Pierrat | 254/93 H |
| 4,925,158 | 5/1990 | Yang | 254/93 H |

*Primary Examiner*—Robert C. Watson
*Attorney, Agent, or Firm*—John D. Jeter

[57] ABSTRACT

An automobile type hydraulic jack is converted from manual to powered actuation by removing the manual actuation handle socket and associated linkages and attaching a frame carrying an electric gear motor with an eccentric rotary output cam situated to reciprocate the original pump plunger to raise the jack. The frame is, preferably, attached to the pump plunger cylinder projection which extends from the jack base. Alternate frames provide for attachment to the pump fluid reservoir housing or to the jack base.

13 Claims, 3 Drawing Sheets

POWERED HYDRAULIC JACK

This invention pertains to lifting devices known as jacks for lifting the wheels of automobiles and the like. More particularly, it pertains to electrically powered jacks of the portable type to be carried in automotive equipment. Preferably, the disclosed device will be added to commonly available manual jacks to convert them to twelve volt motor operation powered by the served vehicle battery.

BACKGROUND OF THE INVENTION

The disabling of vehicles due, primarily, to flat tires is a constant concern for vehicle operators. Operators are often faced with space limitations in using jacks supplied with automobiles. Some jacks require operating positions subject to traffic hazards. Many efforts have been made to reduce the problems but jacks continue a trend toward complexity and linkages that can sever inexperienced fingers and cause many forms of lesser damage. The simple manually operated hydraulic jack has acquired a standard form comprising a lifting ram inside a reservoir housing and a parallel pump plunger housing both rather rugged and extending vertically from a common base. Such jacks are commercially available in a variety of lifting capacities. The usual construction of such jacks provides a socket for manual operating levers that may require the operator to crawl under the vehicle. Further, operation of the lever can dislodge the jack from the vehicle hard point where it was first placed for safe lifting.

There is a need for an economical conversion kit to modify the mass produced hydraulic jacks, readily and economically available on the open market, to motor operated devices that can be powered by a common vehicle battery.

It is therefore an object of this invention to provide a conversion kit, to be attached to a code on manually operable hydraulic jack, after the manual handle socket is removed, to provide an electric motor and gearbox driving an eccentric cam to actuate the host jack input pump plunger for lifting actions.

it is a further object to provide a bearing on the eccentric cam to reduce friction drag when the cam reciprocates the plunger.

These and other objects, advantages, and features of this invention will be apparent to those skilled in the art from a consideration of this specification, including the attached claims and appended drawings.

SUMMARY OF THE INVENTION

A manually operated vertical ram type hydraulic jack is converted by removing the manual handle socket and related linkages, and clamping a conversion kit to the jack structure, preferably to the usual pump plunger cylinder projection. The conversion kit has a frame for clamping to the pump cylinder projection with the frame extending to support a gear motor a gear motor to drive an eccentric output cam on an output shaft extending from the gear motor. The arrangement places the eccentric cam, which is fitted with a roller bearing, such that the rotation of the shaft, with motor running, causes the jack pump plunger to reciprocate to pump fluid to the jack ram to cause it to extend. If the pump plunger has no internal spring to extend the plunger a compression spring is fitted over the plunger to be captured between the original linkage pin on the plunger and the put cylinder projection to keep the plunger extended against the cam. Construction alternatives include optional frames for mounting the power delivery mechanism on the original jack. Jacks of different capacities are often best served by frames of different configurations. The drive motor can be an electric drill with chuck removed and the eccentric carrying shaft substituted, with in intrinsic rechargeable battery or power supply cord, but the arrangement shown is preferred. The electric motor and gear box combination is known as a gear motor and is commercially available for either utility AC power or direct current (DC). If a DC motor is used it can be connected by a cord to a vehicle type battery or to a portable rechargeable pack, preferably combined with switch controls.

BRIEF DESCRIPTION OF DRAWINGS

In the drawings wherein like features have similar captions.

DETAILED DESCRIPTION OF DRAWINGS

Figure 1:
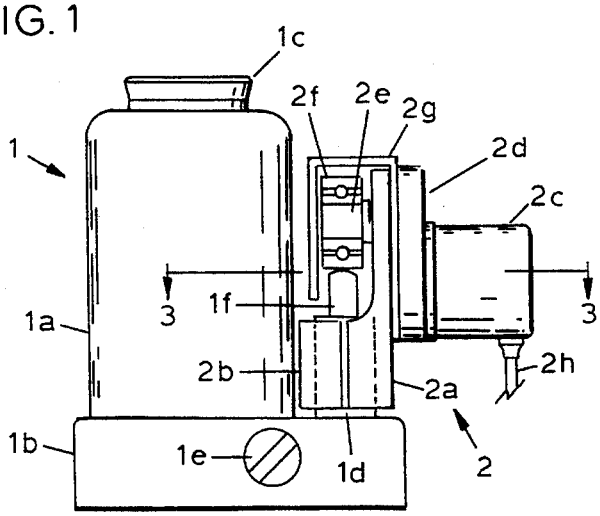
FIG. 1 is a side view of the hydraulic jack with the conversion kit attached.

In the drawings certain features bearing upon manufacturing and maintenance utility, well established in the art, and not bearing upon points of novelty may be omitted in the interest of clarity and descriptive convenience. Such omitted features may include weld lines, fluid galleries, valve details, and some keys and fasteners and the like.

In FIG. 1 the jack 1 has had the usual manual handle socket removed, along with the usual linkage that connects pump plunger 1*f* to the handle socket, and the conversion kit 2 has been installed. The pump cylinder projection 1*d* is common to jacks of the profile shown and frame 2*a* attached to it by way of back plate 2*b* which is secured by screws 2*j* (see FIG. 2) to rigidly support the kit on the jack structure. Electric motor 2*c* and gear box 2*d*, available as a single unit, are attached to the frame by bolts 2*k*. An eccentric bushing 2*e* may be part of the gearbox output shaft or added to a concentric shaft and carries bearing 2*f*. The outer race of bearing 2*f* engages the pump plunger If with an oscillating rolling motion over the upper end of the plunger. When the motor drives the gearbox and turns eccentric 2e the plunger moves up and down a preselected amount. This has the same effect as the pumping manipulation of the original manual handle, or handle socket, now removed and not shown.

Valve 1e is common to such jacks and is closed to raise the jack and opened to lower it. When the valve is closed and the motor is running the jack ram 1c moves upward.

Available jacks of the profile shown have become rather standard in construction, widely produced and generally available at automobile parts and service stores. The reservoir housing 1a is much larger than the ram and an annular reservoir surrounds the ram and contains hydraulic fluid. Check valves and channels in the jack base 1b cooperate with the plunger to provide pumping of fluid from the reservoir to the cylinder inside the jack body that carries the ram. Valve 1e opens the ram cylinder to the reservoir to lower the jack. This form of manually operated jack is old art, well known, and not part of this invention.

Leads 2h provide electric power to the motor. This motor can be rated for utility AC power but is preferably for DC power to operate from the common vehicle battery of a rechargeable battery pack. For battery service, the leads would terminate in battery clamps, a cigarette lighter plug, or rechargeable pack connector.

Figure 2:
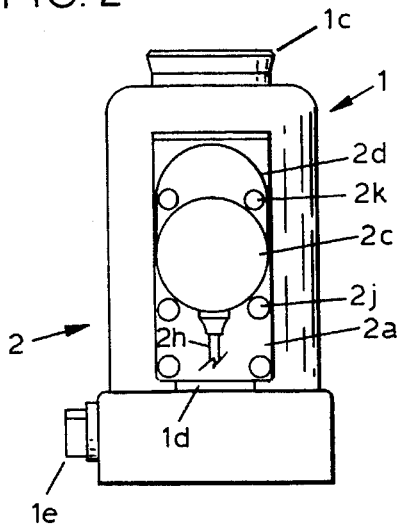
FIG. 2 is an orthogonal view of the assembly of FIG. 1.

FIG. 2 is a motor side view and discloses cap screws 2j to hold the kit o the jack and screws irk which attach the gear box and motor to the frame 2a. Gear head motors are preferred and are commonly supplied as an integral unit.

Cover 2g is optional and is captured between the gear box and frame. Cover 2g is shown with sides open but may have the sides closed to provide more protection for and from the rotating machinery.

Figure 3:
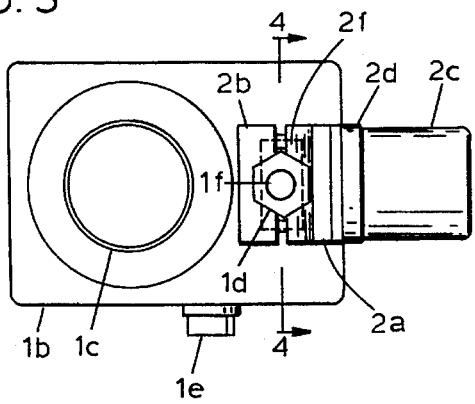
FIG. 3 is a top view of the assembly of FIG. 1, partly cut away along line 3—3.

FIG. 3 in cutting away loses most of the cover 2g and shows phantom bearing 2f in position over the plungers 1f. The cylinder projection 1d has been noted in some cases to be round. Round protrusions are well gripped by hexagonal openings formed by the assembly of plate 2b to frame 2a. Additionally, the hexagonal opening will grip hexagonal protrusions of a range of sizes.

Figure 4:
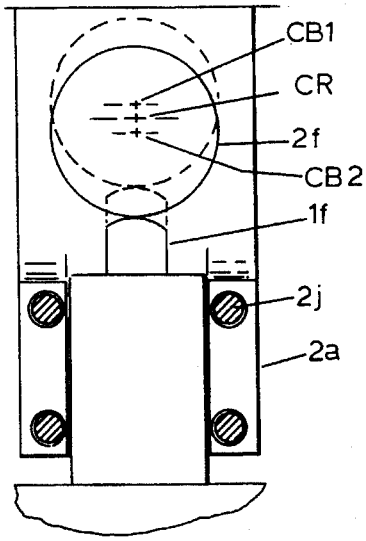
FIG. 4 is sectional view of a selected area of FIG. 3, somewhat enlarged and partly cut away along line 4—4.

FIG. 4 is a somewhat enlarged view of a selected area of FIG. 3 taken along line 4—4. The outer periphery of bearing 2f is shown with its relationship to plunger if. When the gear box shaft (not shown) rotates one half turn about axis CR the center line of the bearing moves from CB1 to CB2 and moves the plunger if as shown. When the kit is installed frame 2a is vertically positioned to provide the bearing and plunger contact throughout the bearing excursion. When the desired position is achieved, screws 2j are tightened to make the adjustment permanent.

Figure 5:
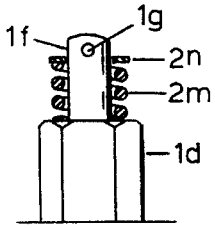
FIG. 5 is a side view of a portion of the jack showing the manner of application of a plunger extending spring.

FIG. 5, showing a side view of a selected area of the original jack, snows the manner of capturing 2m between the original manual linkage pin 1g, with washer 2n, and the top of the projection 1d. This spring keeps the plunger extended against the cam.

FIGS. 6 through 14 comprise the same jacks, gear motors, shafts and cams with different mounting frames. For those elements in common the same captions are used throughout. For descriptive efficiency, some details already clarified in FIGS. 1 through 5 are omitted.

Figure 6:
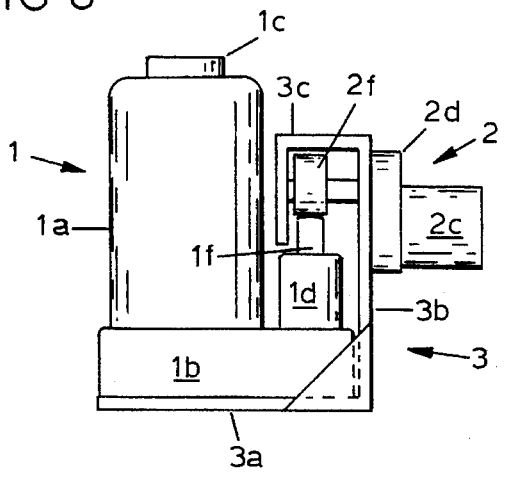
FIG. 6 is a side view of a hydraulic jack with an alternate frame attachment to support the motorized pump driving mechanism.
Figure 7:
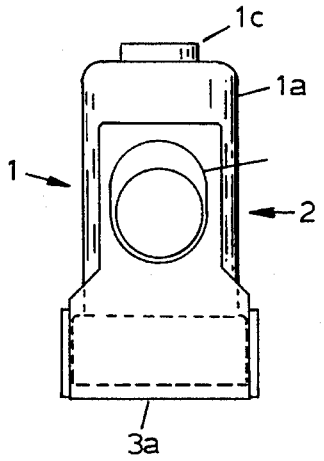
FIG. 7 is an orthogonal view of the jack of FIG. 6 showing the motor mount side.
Figure 10:
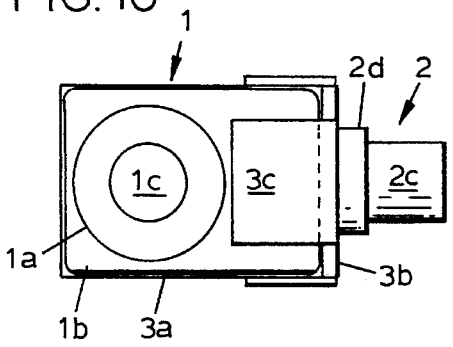
FIG. 10 is a top view of the jack assembly of FIG. 6 and FIG. 7.

FIG. 6 shows jack 1, and actuating mechanism 2 assembled on frame 3. Sole plate 3a, vertical portion 3b and extension 3c support motor 2c and gear box 2d to position eccentric cam 2f over plunger 1f. The operating motor moves fluid from reservoir housing 1a, through pump cylinder 1d (with plunger 1f) to move ram 1c. FIG. 7 shows the motor mount side and FIG. 10 shows the top view.

Figure 8:
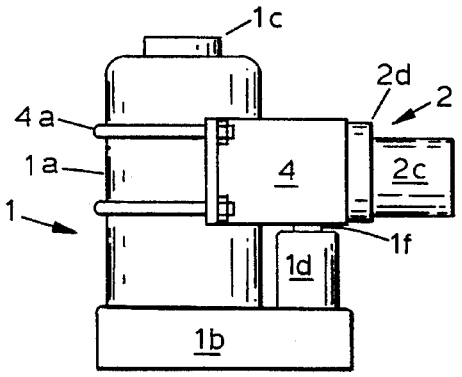
FIG. 8 is a side view of a hydraulic jack and the motorized pump driving mechanism joined by another alternate frame.
Figure 9:
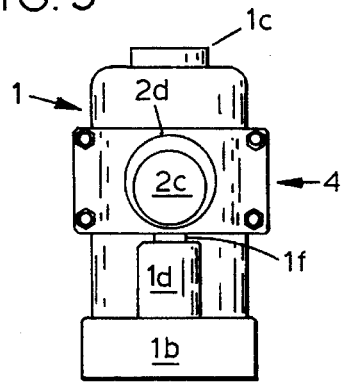
FIG. 9 is an orthogonal view of the jack of FIG. 8 showing the motor mount side.
Figure 11:
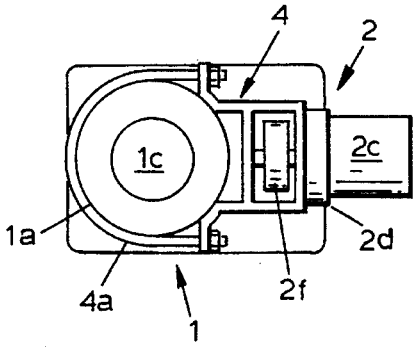
FIG. 11 is a top view of the jack assembly of FIG. 8 and FIG. 9.

FIGS. 8, 9, and 11 show the side, motor mount side, and top views of an alternate assembly using frame 4 to clamp about reservoir housing 1a by way of U bolts 4a. Actuator 2 as previously described herein is positioned over plunger cylinder 1d without attachment to base 1b.

Figure 12:
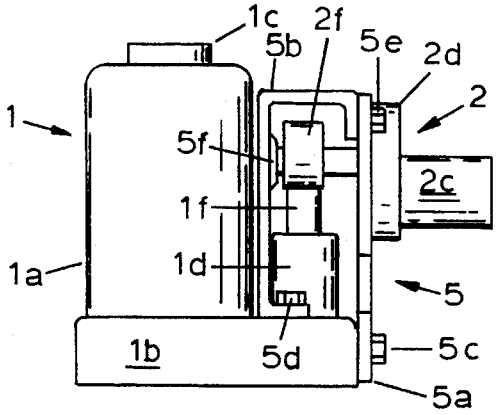
FIG. 12 is a side view of a jack assembly utilizing an alternate frame to associate a the converted jack and the motorized pump driving mechanism.
Figure 13:
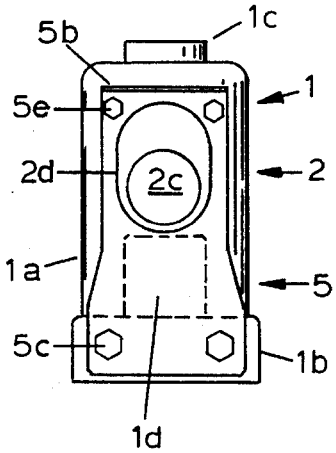
FIG. 13 is an orthogonal view of the jack assembly of FIG. 12 showing the motor mount side.
Figure 14:
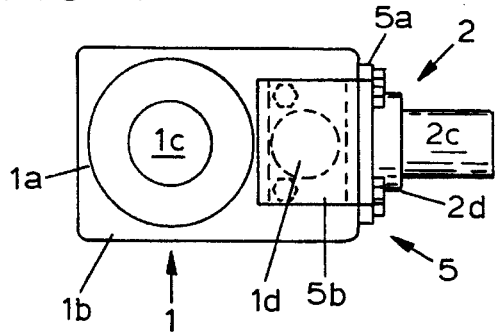
FIG. 14 is a top view of the jack of FIGS. 12 and 13.

FIGS. 12, 13, and 14 represent jack 1 and actuator mechanism 2 assembled by way of frame 5 by bolting to base 1b. Vertical member 5a is secured by screws 50 to the base. Extension 5b is secured to the base by screws 5d. Screws 5e, if used in preference to welding, join 5a and 5b. The resulting frame positions motor 2c, gearbox 2d, with eccentric cam 2f over plunger if to reciprocate it in pump cylinder 1d to move fluid from the reservoir in housing 1a to the lifting cylinder (not-shown) to raise ram 1c. Outboard bearing 5f supports the shaft carrying cam 2f to reduce cantilever loads on the gearbox output shaft. This arrangement is well suited for very large jacks.

It is obvious that any adapter kit arrangement can be installed on the intended host device at the time the host device is produced. In this case, the kit can be installed on a jack intended, by design, for manual use but before the manual actuator accesories are installed. This is anticipated by and is within the scope of the claims.

From the foregoing, it will be seen that this invention is one well adapted to attain all of the ends and objects hereinabove set forth, together with other advantages which are obvious and which are inherent to the device. It will be understood that certain features and sub combinations are of utility and may be employed without reference to other features and sub-combinations. This is contemplated by and is within the scope of the claims.

As many possible embodiments may be made of the device of this invention without departing from the scope thereof, it is to be understood that all matter herein set forth or shown in the accompanying drawings is to be interpreted as illustrative and not in a limiting sense.

The invention having been described, I claim:

1. A conversion device for converting an automobile type hydraulicjack designed to be manually powered into an electrically powered jack, the original jack having surfaces comprising a body with a base, having a base plane, a reservoir housing and a pump cylinder projection carrying a reciprocating pump plunger, extending from said base, said design providing removable means to manually reciprocate said plunger, the device comprising:

a) a frame with at least one mating surface for mounting on at least one of said surfaces of said jack body when said means to manually reciprocate said plunger is absent;

b) a gear box mounted on said frame with a rotary output shaft situated to extend at a generally right angle across the extended axis of said plunger;

c) an electric motor mounted on said gear box with a second output shaft arranged to provide rotary input to said gearbox;

d) an eccentric cam rotationally secured to said first output shaft with a periphery comprising a surface on an outer member of a bearing mounted for rotation thereon positioned to contact said plunger such that when said eccentric cam is rotated said plunger is caused to axially reciprocate; and e) a flexible electric conductor of some length with one end extending to said motor and electrically connected thereto to provide electric power to said motor.

2. The conversion device of claim 1 wherein said bearing comprises a rolling element bearing.

3. The conversion device of claim 1 wherein said bearing comprises a sleeve bearing.

4. The conversion device of claim 1 wherein a compression spring is disposed about said plunger and situated to bear on said projection and said plunger to bias said plunger to extend from said projection.

5. A conversion device for converting an automobile type hydraulic jack designed to be manually powered into an electrically powered jack, the design having generally parallel axes for a pump plunger and a lifting ram, both assembled on a base from which a projection extends to serve as a cylinder to carry said plunger, the design providing removable manual powering means, the device comprising:

a) a frame arranged for attachment to said projection in the absence of said manual powering means;

b) a gear box, with a rotary output shaft, attached to said frame and situated such that the axis of rotation of said output shaft generally crosses the extended axis of said plunger;

c) an eccentric cain rotationally secured to said output shaft with an outer periphery comprising a surface on an outer member of a bearing mounted for rotation thereon to engage and reciprocate said plunger;

d) an electric motor attached to said gear box and arranged to provide rotary input thereto to drive said cam; and e) a power cord of some length with at least two electric conductors with one end electrically connected to said motor to provide electric power thereto.

6. The conversion device of claim 5 wherein said frame is attachable to said projection by a clamp comprising a trough in said frame and in an opposing plate, the resulting trough opening being adjustable by drawing said plate toward said frame by threaded fasteners to clamp about said projection.

7. The conversion device of claim 5 wherein said bearing is a rolling element bearing.

8. The conversion device of claim 5 wherein said bearing comprises a sleeve bearing.

9. The conversion device of claim 5 wherein a compression spring is disposed about said plunger and situated to bear on said projection and said plunger to bias said plunger to extend from said projection.

10. A conversion device for converting an automobile type hydraulic jack, designed to be manually powered by removable manual operating means, into an electrically operated jack, the original jack having surfaces comprising a body with a base having a base plane, a reservoir housing, and a pump cylinder projection carrying a reciprocating pump plunger, extending from said base, the device comprising:

a) a frame with at least one mating surface for mounting on at least one of said surfaces of said jack body;

b) a gear box mounted on said frame with a rotary output shaft situated to extend at a generally right angle across the extended axis of said plunger;

c) an electric motor mounted on said gear box with a second output shaft arranged to provide rotary input to said gearbox;

d) an eccentric cam rotationally secured to said first output shaft with a periphery comprising a surface on an outer member of a bearing mounted for rotation thereon positioned to contact said plunger such that when said eccentric cam is rotated said plunger is caused to axially reciprocate; and e) a flexible electric conductor of some length with one end extending to said motor and electrically connected thereto to provide electric power to said motor.

11. The conversion device of claim 10 wherein said bearing comprises a rolling element bearing.

12. The conversion device of claim 10 wherein said bearing comprises a sleeve bearing.

13. The conversion device of claim 10 wherein a compression spring is disposed about said plunger and situated to bear on said projection and said plunger to bias said plunger to extend from said projection.

* * * * *